US009125473B2

(12) United States Patent
Lefol

(10) Patent No.: US 9,125,473 B2
(45) Date of Patent: Sep. 8, 2015

(54) SYSTEM FOR PACKAGING AND APPLYING A PRODUCT, IN PARTICULAR A COSMETIC PRODUCT

(75) Inventor: Emmanuel Lefol, Saran (FR)

(73) Assignee: Parfums Christian Dior, Paris (FR)

( * ) Notice: Subject to any disclaimer, the term of this patent is extended or adjusted under 35 U.S.C. 154(b) by 52 days.

(21) Appl. No.: 14/233,249

(22) PCT Filed: Jul. 20, 2012

(86) PCT No.: PCT/FR2012/051731

§ 371 (c)(1),
(2), (4) Date: Jan. 16, 2014

(87) PCT Pub. No.: WO2013/014380

PCT Pub. Date: Jan. 31, 2013

(65) Prior Publication Data

US 2014/0147188 A1 May 29, 2014

(30) Foreign Application Priority Data

Jul. 22, 2011 (FR) ..... 11 56672

(51) Int. Cl.

| | |
|---|---|
| ***A45D 34/04*** | (2006.01) |
| ***A45D 40/00*** | (2006.01) |
| ***A45D 40/26*** | (2006.01) |

(52) U.S. Cl.

CPC ..... *A45D 40/00* (2013.01); *A45D 34/045* (2013.01); *A45D 40/265* (2013.01)

(58) Field of Classification Search

CPC ..... A45D 34/045
USPC ..... 401/118, 123, 126, 127, 129; 215/207, 215/226, 229, 273, 280, 281, 282, 283
See application file for complete search history.

(56) References Cited

U.S. PATENT DOCUMENTS

| | | | | |
|---|---|---|---|---|
| 3,337,901 | A * | 8/1967 | Schefer et al. | 401/129 |
| 4,917,520 | A | 4/1990 | Reid | |
| 5,116,154 | A * | 5/1992 | Fulkerson | 401/127 |
| 2005/0081878 | A1 | 4/2005 | Byun | |

FOREIGN PATENT DOCUMENTS

| | | | |
|---|---|---|---|
| DE | 19642720 | A1 | 4/1998 |
| EP | 1800561 | A1 | 6/2007 |
| FR | 2113799 | A1 | 11/1970 |

OTHER PUBLICATIONS

International Search Report and Written Opinion for related International Application Serial No. PCT/FR2012/051731; report dated Sep. 11, 2012.

* cited by examiner

*Primary Examiner* — David Walczak
*Assistant Examiner* — Joshua Wiljanen
(74) *Attorney, Agent, or Firm* — Miller, Matthias & Hull LLP

(57) ABSTRACT

The present invention relates to a system for packaging and applying a product, including a container intended for containing said product and having a neck and a bottom, the neck extending along a longitudinal axis; a product application assembly including a closing element suitable for closing the container and a product application secured to said closing element and intended for being inserted in said container in order to be loaded with the product to be applied; a retaining device suitable for retaining said application assembly on said container, and movable mounted between an operative configuration in which the application assembly is retained on the container, and an inoperative configuration in which the application assembly can be removed from the container; a resilient element provided such as to adopt a stressed configuration when the retaining device is in the operative configuration thereof.

13 Claims, 7 Drawing Sheets

FIG. 2
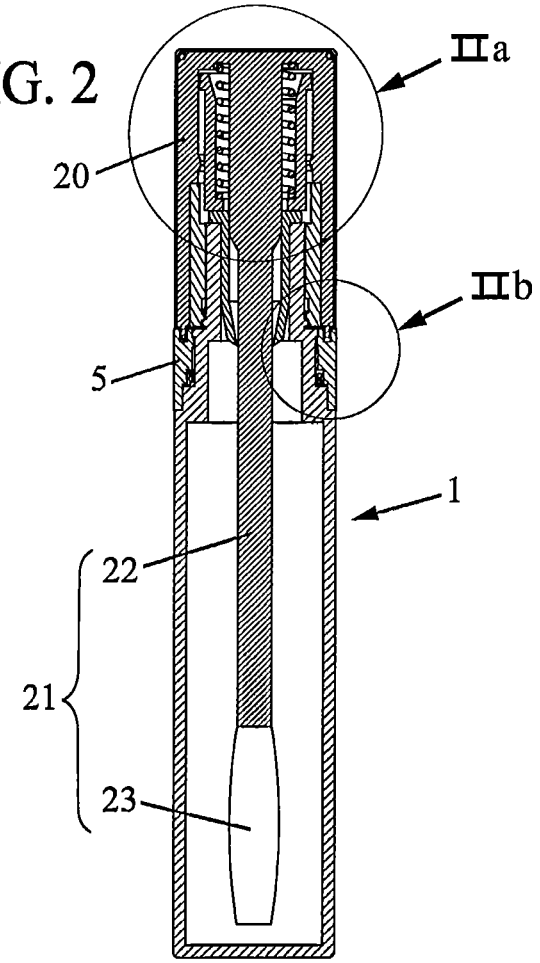
FIG. 2b
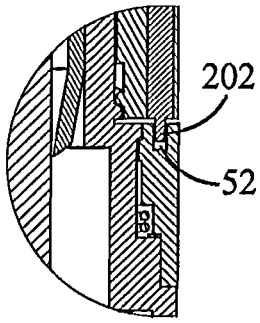
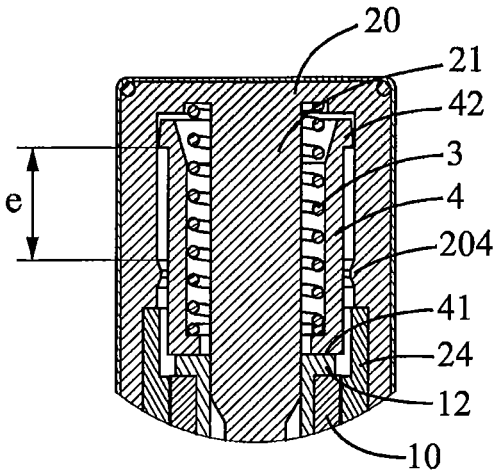
FIG. 2a

FIG. 3
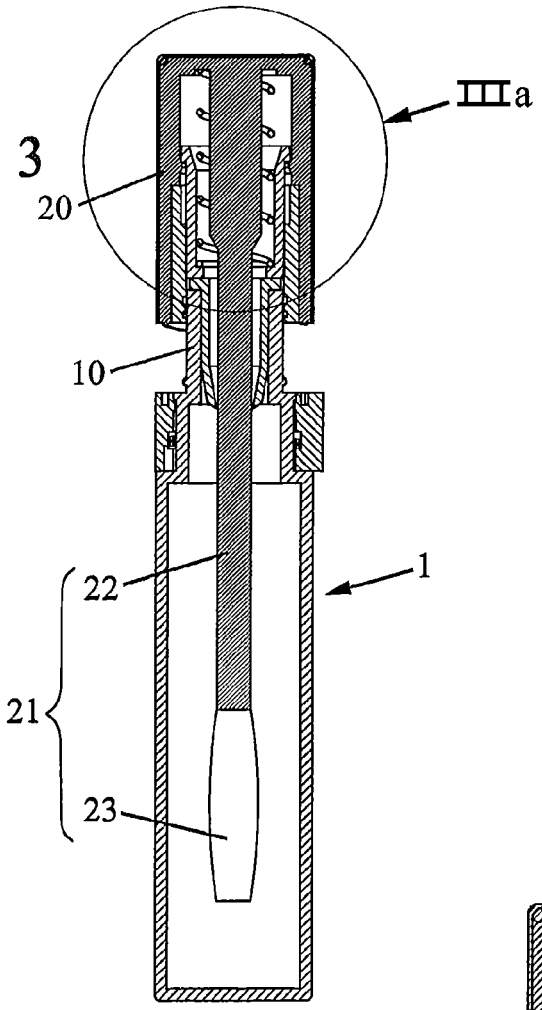
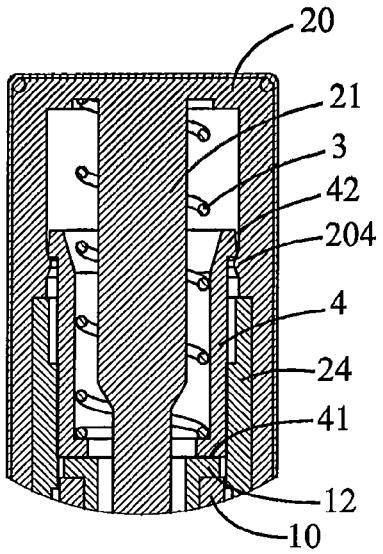
FIG. 3a

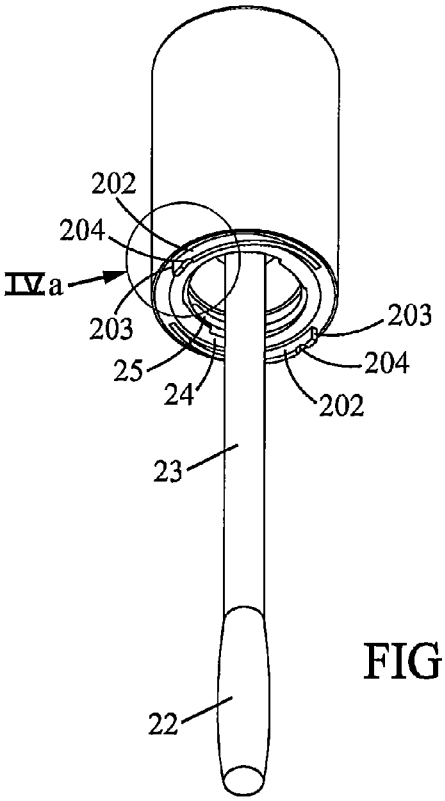
FIG. 5
FIG. 5a
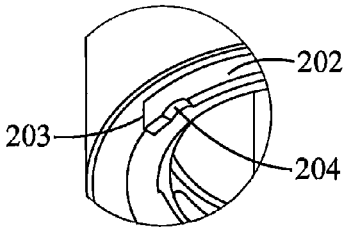
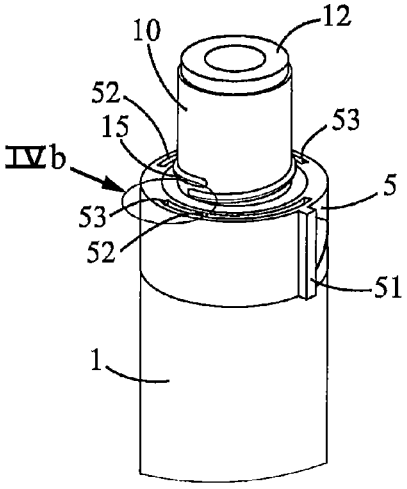
FIG. 5b
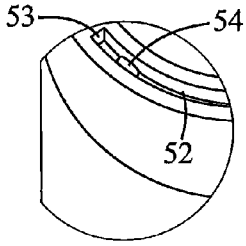

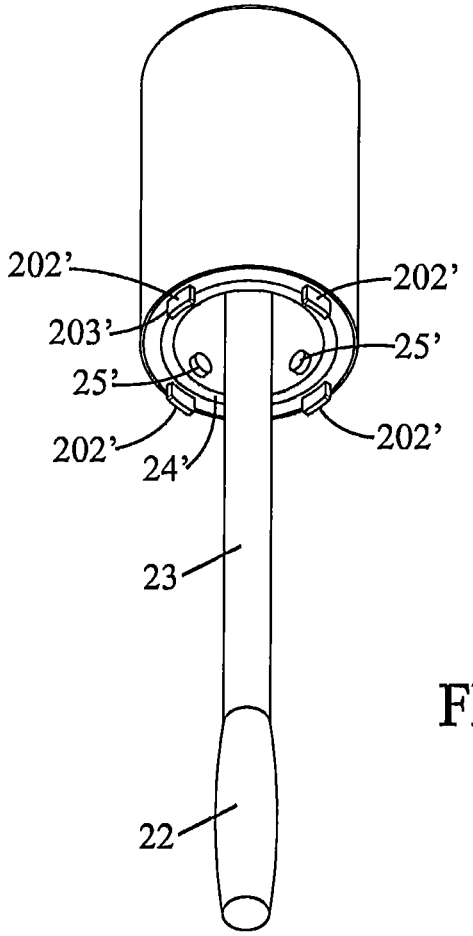
FIG. 6
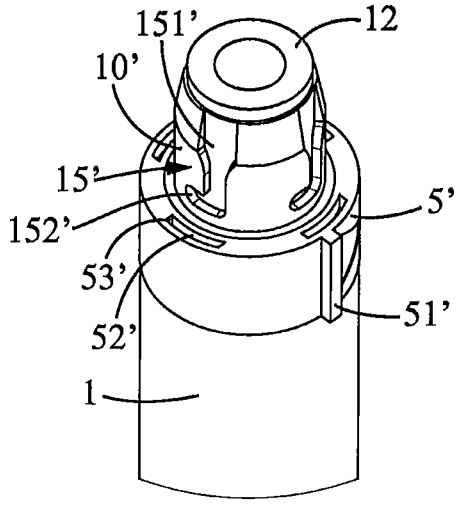

SYSTEM FOR PACKAGING AND APPLYING A PRODUCT, IN PARTICULAR A COSMETIC PRODUCT

CROSS-REFERENCE TO RELATED APPLICATIONS

This application is a 35 USC §371 U.S. national stage filing of International Patent Application No. PCT/FR2012/051731 filed on Jul. 20, 2012, and claims priority under the Paris Convention to French Patent Application No. FR 11 56672 filed on Jul. 22, 2011.

FIELD OF THE DISCLOSURE

The present invention relates to a system for packaging and applying a product, particularly a cosmetic product, and the use of such a system.

BACKGROUND OF THE DISCLOSURE

More particularly, the invention relates to a system for packaging and applying a product, comprising:

- a container intended for containing said product and having a neck and a bottom, the neck extending along a longitudinal axis;
- a product application assembly including a closing element adapted for closing the container, and a product applicator secured to said closing element and intended for insertion into said container in order to be loaded with the product to be applied;
- a retaining device adapted for retaining said application assembly on said container, and mounted to be movable between an operative configuration in which the application assembly is retained on the container and an inoperative configuration in which the application assembly can be removed from the container;
- a resilient element provided so as to adopt a stressed configuration when the retaining device is in the operative configuration, the transition to the inoperative configuration of the retaining device causing the expansion of said resilient element.

Document EP1800561A1 discloses an example of such a system where the application assembly has a closing cap and an application shaft slidably mounted inside said cap and resiliently biased to an extended position in which the shaft protrudes the furthest from said cap. In the storage position, the shaft of the application assembly, resting on the neck of the container, is retracted inside the cap which compresses an internal spring, the cap being held in this position via the complementary retaining means provided on the cap and the container. These retaining means comprise locking balls arranged at said cap and intended to enter into a complementary groove provided on the container neck, and a sleeve associated with said cap and adapted to keep said locking balls within said groove in the operative configuration of said retaining means, thereby preventing removal of said application assembly from said container. When a user wishes to use the application assembly, the user grasps the container and lifts the sleeve relative to the cap so as to allow the balls to disengage relative to the container neck. The cap is then no longer retained on the container in the axial direction, which causes the expansion of the inner spring and drives the cap away from the shaft and the container, allowing the removal of the application assembly from the container.

Thus, when the user acts to disable the retaining means, only the cap of the applicator is moved along a specific axial stroke away from the container under the effect of the relaxing inner spring, the shaft remaining inside the container, resting on its neck.

This cap then constitutes a gripping and manipulation element that the user grasps in order to withdraw the shaft from the container and apply the product to a surface. Once withdrawn from the container, the shaft is only held in its extended position relative to the cap by the resilient urging of the internal spring. When a user wishes to apply the product loaded on the applicator shaft to a surface while gripping the cap, this cap may be pushed over the shaft against the elastic force of the spring, which can interfere with proper application, especially in terms of precision and uniformity of the applied layer of product. Such internal mobility of the application assembly additionally harms the user's overall perception of the quality of the product packaging and application system.

SUMMARY OF THE DISCLOSURE

The present invention is intended to overcome these disadvantages.

According to the invention, a system for packaging and applying a product of the aforementioned type is characterized in that the application assembly is movable along the longitudinal axis between a closed position in which the closing element seals the container, and a removal position where it is distanced from said container along the longitudinal axis, and in that the resilient element in the stressed configuration biases the application assembly towards the removal position, the expansion of the resilient element resulting in movement of the application assembly along an axial ejection stroke relative to the container along the longitudinal axis.

This axial ejection stroke of the application assembly relative to the container can be defined as the axial distance traveled by said application assembly between its closed and removal positions.

With these features, a true ejection of the application assembly relative to the container is obtained, the product applicator and the closing element thus forming a gripping and handling element for the application assembly, being presented to the user as partially ejected out of the container after the expansion of the spring element caused by the passage to the inoperative configuration of the retaining device. Gripping the application assembly and removing it from the container is thus facilitated.

Furthermore, when the application assembly is removed from the container, the product applicator and the closing element do not exhibit a relative mobility that could affect the quality of the product application, or harm the general perception of the quality of the system for packaging and applying a product.

The invention also aims to provide a system for packaging and applying a product which is particularly ergonomic to open and can be opened with one hand, and where the user has various options for releasing the retaining device holding the application assembly on the container.

In said document EP1800561A1, a user wishing to open the packaging system must grasp the container and act on the sleeve associated with the cap in order to release of the retaining means. This maneuver can be difficult to achieve with only one hand and depends on which part of the container is being held by the user, because the means for releasing the retaining means are constituted by the sleeve provided at the cap.

Therefore, in a particularly advantageous embodiment, the system for packaging and applying a product according to the invention further comprises a release device, separate from the retaining device, arranged on the container so as to be movable between a rest position and a release position, and the actuation of said release device causes said retaining device to transition to the inoperative configuration. Actuation is understood here to mean the transition of the release device from its rest position to its release position.

In this manner, a user of the system for packaging and applying a product of the invention can cause the release of the retaining device, resulting in the expansion of the resilient element and the ejection of the application assembly relative to the container, by holding the container and acting either directly on the application assembly or via the release device arranged on the container, to place the retaining device in the inoperative configuration.

The ergonomics of the system are also improved, as the user is able to cause the ejection of the application assembly relative to the container by grasping it and actuating the release device associated therewith, without having to act directly on the application assembly. Indeed, with such an arrangement, the user holding the container with the whole hand can cause ejection of the application assembly relative to the container by actuating, for example with the thumb, the release device associated with the container. As a result, the system for packaging and applying a product of the invention is particularly easy to open.

In preferred embodiments of the invention, one or more of the following arrangements may be used:

a biasing element is provided for returning the release device to its rest position;

the release device includes:

at least one actuating element which a user can act upon to actuate the release device, and at least one drive element for moving the application assembly relative to the container, adapted to transition the retaining device from its operative configuration to its inoperative configuration upon actuation of said release device;

the transition of the retaining device from the operative configuration to the inoperative configuration is effected by rotation of the application assembly relative to the container about the longitudinal axis in a release direction, the at least one drive element provided on the release device being a drive element for rotating in the release direction. With such an arrangement, the risk of accidental ejection of the application assembly relative to the container is reduced; indeed, as the deactivation of the retaining device holding the application assembly on the container occurs by rotation about the longitudinal axis of said container, the risk of unintentionally opening the packaging and application system is minimized, for example when it is inside a purse or bag and the user reaches blindly inside to pick it up;

the retaining device is in the form of an external thread provided on the neck of the container and adapted to engage with an internal thread provided in the closing element of the application assembly. Such a screw-on retaining device ensures optimum sealing of the packaging and application system during retention of the application assembly on the container;

the external thread provided on the neck and the internal thread provided in the closing element are adapted for transitioning from the operative configuration to the inoperative configuration by a relative rotation in the release direction over an angle of less than 360°, preferably less than 180°, and even more preferably about 90°. With such a retaining device providing retention by a quarter-turn twist, a good seal of the system for packaging and applying a product is guaranteed while offering the ability to open it quickly;

the retaining device is in the form of a bayonet catch system comprising at least one groove provided on the container neck and adapted to engage with at least one pin provided in the closing element of the application assembly, said groove having an axial portion and a retaining portion extending in the circumferential direction of the product packaging and application system over an arc of less than 90°, and preferably about 20';

the release device is in the form of a rotatable ring arranged on the container in the vicinity of the neck, and having at least one groove formed in a surface facing the application assembly, the at least one rotational drive element being formed by a front end of said groove adapted to cooperate with a front face of at least one tooth formed in a surface of the application assembly facing said ring, said at least one tooth being received within said at least one groove when the application assembly is in the closed position;

the at least one actuating element is in the form of a radial rib protruding from the outer surface of the rotatable ring;

the applicator comprises a shaft extending along the longitudinal axis (X) from the bottom of the closing element and equipped at a free end with an applicator head intended to be loaded with product to be applied, and the container is provided with a wringing element adapted for wringing said applicator.

The system for packaging and applying a product may further comprise a sound-generating device to indicate that the retaining device has reached the end of its travel when it transitions from the inoperative to the operative configuration. This sound-generating device may be formed by a boss provided on the bottom of the at least one groove formed in the rotatable ring, adapted to cooperate with a recess provided in the at least one tooth of the application assembly in order to indicate that the retaining device has reached the operative configuration. In the embodiment where the retaining device is in the form of an external/internal thread system, the sound-generating device may alternatively be in the form of a boss provided on the bottom of the thread of the closing element, adapted to cooperate with a recess provided in the thread of the container neck in order to indicate that the retaining device has reached the operative configuration.

According to another advantageous arrangement of the invention, the system for packaging and applying a product further comprises an ejection element movably arranged inside the closing element of the application assembly and having a face adapted for bearing axially on the container, as well as an axial stop for cooperating with an axial stop provided in the closing element in order to limit the movement of said ejection element within said closing element, the resilient element being arranged between said ejection element and said closing element, and the ejection stroke of said application assembly relative to said container corresponding to at least the axial distance between said stops when the retaining device is in the operative configuration.

The invention also relates to the use of such a system for packaging and applying a product, for the application of a cosmetic product to a surface, for example the skin, lips, nails, and/or keratin structures (eyelashes, eyebrows, hair . . . ).

Other features and advantages of the invention will become apparent from the following description of one of its embodiments, given by way of non-limiting example, with reference to the accompanying drawings.

BRIEF DESCRIPTION OF THE DRAWINGS

In the drawings:

FIG. 2 shows a longitudinal cross-sectional view of a system for packaging and applying a product according to the invention, the application assembly being in the closed position on the container;

FIG. 2*a* shows an enlarged view of the packaging and application system of FIG. 2 at the ejection element, showing the minimum ejection stroke of said application assembly relative to said container;

FIG. 2*b* shows an enlarged view of the packaging and application system of FIG. 2 at the release device, showing a tooth of the application assembly housed in a groove formed in the release device, the application assembly being in the closed position on the container;

FIG. 3 shows a longitudinal cross-sectional view of a system for packaging and applying a product according to the invention, the application assembly being in the removal position relative to the container;

FIG. 3*a* shows an enlarged view of the packaging and application system of FIG. 3, with the ejection element of the application assembly in the removal position relative to said container;

FIG. 5 shows a perspective view of the packaging and application system according to the invention, illustrating the drive elements provided on the release device;

FIGS. 5*a* and 5*b* show details of FIG. 5 to illustrate an embodiment of the sound-generating device for indicating that the retaining device has reached the operative configuration;

FIG. 6 shows a view similar to FIG. 5 but with the retaining device in the form of a bayonet catch arrangement;

DETAILED DESCRIPTION OF THE DISCLOSURE

The same references are used to denote identical or similar elements in the different figures.

Figure 1:
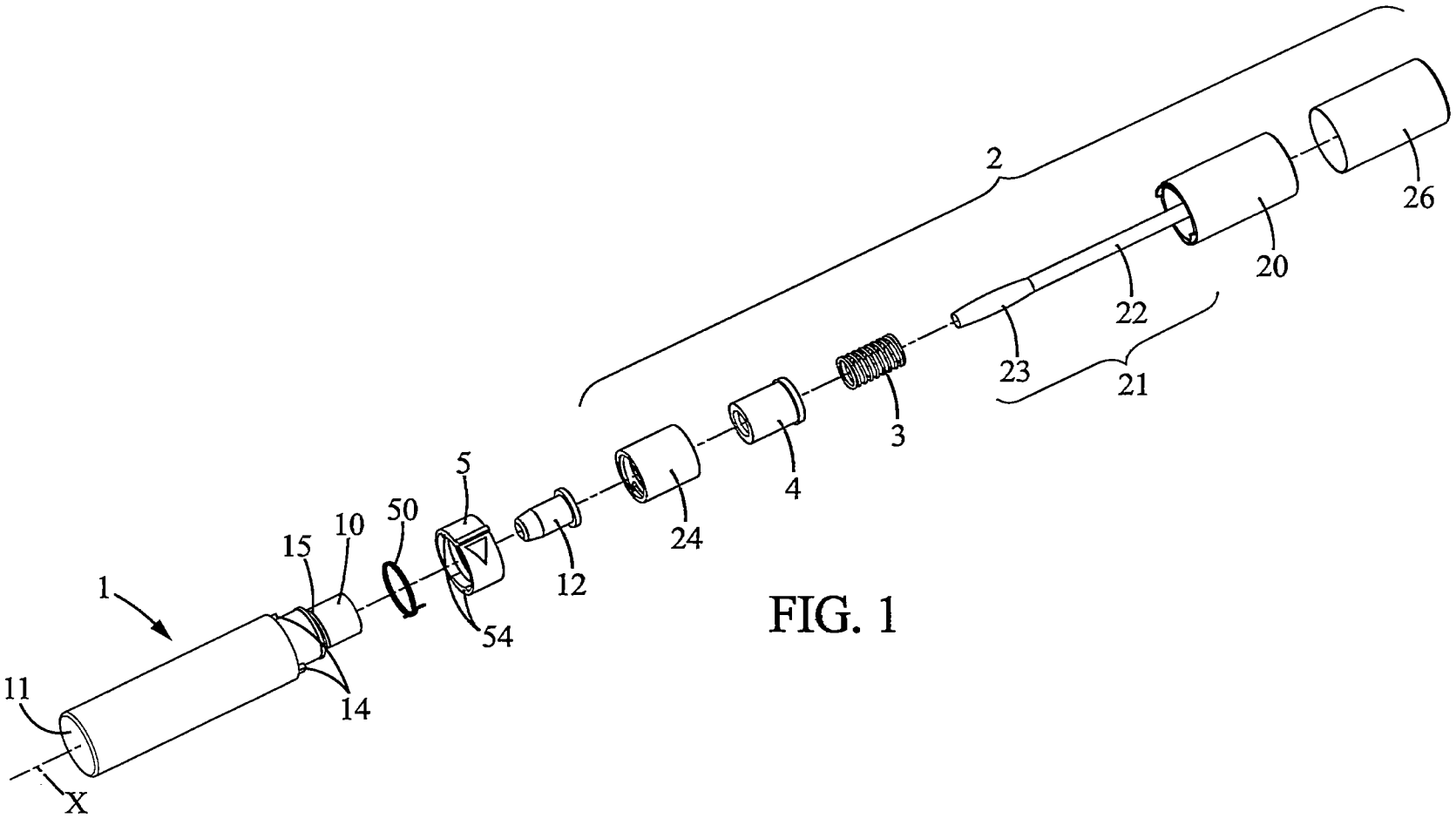
FIG. 1 represents an exploded perspective view of a system for packaging and applying a product according to the invention.

FIG. 1 shows an exploded perspective view of one embodiment of the system for packaging and applying a product according to the invention, in which a container 1 containing a product to be applied is intended to receive an application assembly 2, and a retaining device 15, 25 provided on these two elements enables their relative immobilization when said retaining device is in the operative configuration.

As can be seen in FIG. 1, the container 1 has a neck 10 and a bottom 11, said neck being provided with an external thread 15 composed of two half-helixes intended to cooperate with a complementary internal thread 25 arranged on an insert 24 integral with the application assembly 2 when the retaining device is in the operative configuration. As will be explained in more detail below, specifically in connection with FIGS. 4 and 7*a*-7*d*, this external thread/internal thread system constituting the retaining device is in the form of a "quarter-turn" attachment system, meaning a system in which the relative rotation of the elements on which the external thread and the internal thread are arranged, in a release direction over an angle substantially equal to 90°, causes the retaining device to transition from the operative configuration to the inoperative configuration.

Still in relation to FIG. 1, the application assembly 2 comprises a closing element 20 adapted to seal the container 1 by being screwed onto the neck 10 when the application assembly is in the closed position, and a product applicator 21 formed of a shaft 22 extending along a longitudinal axis X from the closing element 20, and an applicator head 23 provided at the free end of the shaft 22 and intended to be loaded with the product to be applied when inserted into the container 1. A wringer element 12 fitted inside the neck 10 of the container and resting on the upper surface thereof by means of a collar is provided so as to wipe the shaft 22 and wring the applicator head 23 in order to remove excess product when the application assembly 2 is removed from the container 1.

The closing element 20 may optionally be provided with a decorative cover 26.

The application assembly 2 further comprises an resilient element in the form of a coil spring 3, as well as an ejection element in the form of a ring 4, both elements defining a minimum axial ejection stroke e of the application assembly 2 relative to the container 1 when the retaining device transitions from the operative configuration to the inoperative configuration, as will be described in more detail in relation to FIGS. 2, 2*a*, 3 and 3*a*.

As can be seen in particular in FIG. 2, the resilient element 3 is provided for adopting a constraint configuration where it is compressed in the axial direction X when the application assembly is in the closed position on the container and is retained thereon by means of the retaining device in the operative configuration.

More specifically, and as shown in FIG. 2*a*, the resilient element 3 is arranged inside the closing element 20 of the application assembly 2 so as to extend around the shaft 22 between the bottom of the closing element 20 and an axial support surface provided on the ejection element 4. This ejection element 4 is arranged so as to be movable in the axial direction X inside the closing element 20 while being subject to the force exerted by the spring 3, biasing said ejection element 4 away from the bottom of the closing element 20. This movement in the axial direction X is limited by an axial stop, formed for example by a ridge 204 protruding inwardly from the closing element in the radial direction, as shown in FIGS. 2*a* and 3*a*, intended for cooperating with an axial stop provided on the ejection element 4 and consisting for example of a flange 42 extending outwardly from the ejection element 4 in the radial direction.

When the retaining device holding the application assembly on the container is in the operative configuration, an axial support surface 41 of the ejection element 4 bears down on the container 1, or more specifically as shown in FIGS. 2 and 2*a* on the upper side of the wringer element 12 integral with the neck 10 of the container 1. In this position, the resilient element 3 is compressed in the axial direction and the axial ejection stroke of the ejection of the application assembly relative to the container caused by the release of the retaining device can be defined as being at least equal to the axial distance e between the axial stops on the closing element 20 and ejection element 4.

Indeed, as is particularly evident in FIGS. 3 and 3*a* where the application assembly is in the removal position relative to the container and the retaining device holding the application assembly on the container is in the inoperative configuration, when said application assembly is no longer being retained, relative to said container, in the axial direction by said retaining device, the resilient element 3, at least partially relaxing its internal compressive stresses, presses against the ejection element 4 which itself presses axially against the wringing element 12 integral with the neck of the container 10, and moves the application assembly 2 away from the container 1 by acting on the bottom of the closing element 20 until the internal ridge 204 provided on the closing element 20 comes into contact, in the axial direction, with the external flange 42 provided on the ejection element 4.

In this position, illustrated in particular in FIG. 3*a*, the ejection element 4 continues to lean axially on the container 1 and the resilient element 3 prevents the application assembly 2 from returning inside the container 1 under the effect of its own weight.

The axial ejection stroke of the application assembly 2 relative to the container 1 may, however, be greater than the distance between the axial stops provided on the closing element 20 and ejection element 4. When the retaining device is placed in the inoperative configuration, only the friction existing between the shaft 22 and the wringing element 12 brakes the movement in the axial direction of the application assembly 2 relative to the container 1 under the effect of the expansion of the resilient element 3. The properties of said resilient element 3, particularly its stiffness, can be chosen so that the application assembly is ejected from the container 1 beyond the axial distance between the axial stops provided on the closing element 20 and ejection element 4, the ejection movement going against the axial component of the friction force existing between the shaft 22 and the wringing element 12 and being gradually braked by said wringing element. The return in the axial direction of the application assembly 2 into the container 1 under the effect of its own weight will be blocked by the axial component of the static friction force existing between the shaft 22 and the wringing element 12 at the end of the ejection stroke of the application assembly relative to the container 1.

Figure 4:
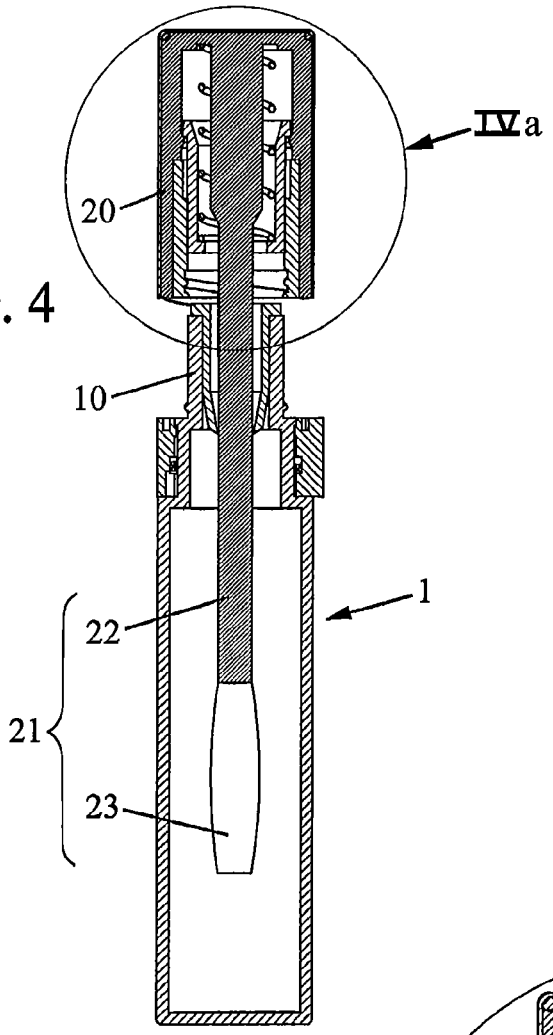
FIGS. 4 and 4*a* represent views similar to those of FIGS. 3 and 3*a*, but where the application assembly has been ejected from the container along an axial stroke greater than the one illustrated in FIGS. 3 and 3*a;*
Figure 4A:
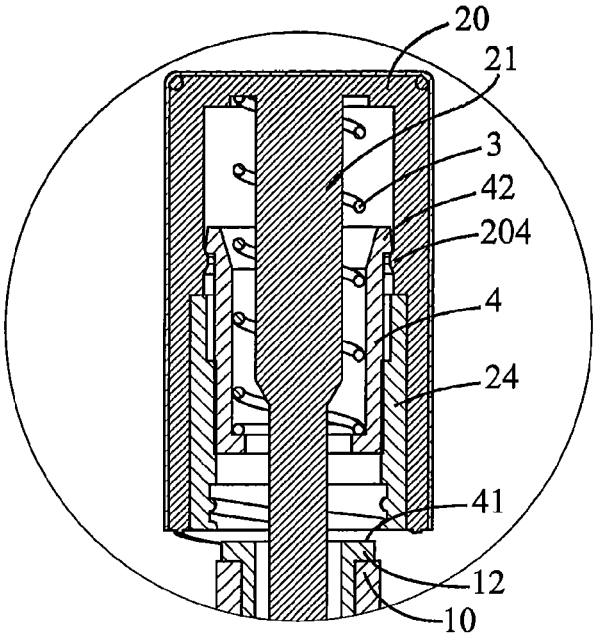

In this case, as illustrated in FIGS. 4 and 4*a*, when the application assembly is in the removal position, meaning after it has been ejected along the axial ejection stroke towards the outside of the container, the ejection element 4 is no longer in axial abutment with the container 1 and only the static friction existing between the shaft 22 and the wringing element 12 prevents the application assembly 2 from returning inside the container 1 under the effect of its weight.

In any event, the properties of the resilient element 3 will be chosen so that the release of the retaining device cannot cause complete ejection of the application assembly 2 from the container 1, and in particular so that the applicator head 23 cannot pass through the wringing element 12 under the effect of the expansion of the resilient element 3.

As shown in FIG. 5 in particular, the retaining element 15, 25 is in the form of a "quarter-turn" system comprising external thread formed of two half-helices provided at the neck of the container 10 and intended to cooperate with a complementary internal thread 25 provided on an insert 24 integral with the closing element 20 of the application assembly 2. Starting from the closed position, illustrated for example in FIG. 2, where the applicator is inserted inside the container 1 and the closing element 20 is retained in the axial direction relative to the container 1 via the retaining device 15, 25, the release of said retaining device, meaning the transition from the operative configuration to the inoperative configuration, is achieved for example by rotating the application assembly 2 relative to the container in a release direction by an angle substantially equal to a quarter of a turn, i.e. about 90°.

When a user wants to use the application assembly to apply the product to a surface, the user grasps the container, for example by the palm of her hand, and rotates the application assembly relative to said container 1 in the release direction for an angle of about 90° about the longitudinal axis X while acting on the outer surface of the closing element, for example by means of her thumb and/or index finger. The retaining device, consisting of the external thread 15 on the container neck and the internal thread 25 on the closing element of the application assembly, then transitions from the operative configuration to the inoperative configuration in which the external thread 15 no longer cooperates with the internal thread 25 in order to retain the application assembly 2 in the axial direction relative to the container 1. This transition of the retaining device to the inoperative configuration causes expansion of the resilient element 3 which, as it is pressing against the container, pushes on the bottom of the closing element 20 and moves the application assembly 2 towards the outside of the container 1 along an axial ejection stroke. At the end of the ejection stroke, the application assembly 2 is in the removal position and can be grasped by the user by means of the closing element which thus forms a gripping member, for its complete removal from the container and for applying the product loaded on the applicator head 22 to a surface.

To return the application assembly 2 to the closed position on the container 1 when it has been completely removed therefrom, the user grasps the closing element 20, inserts the applicator 21 formed of the shaft 22 and the applicator head 23 into the container 1 through the neck 10 and the wringing element 12, and brings the support surface 41 of the ejection element 4 into contact with the upper face of the wringing element 12. Continuing the movement in the axial direction of inserting the application assembly 2 into the container, the spring 3 is compressed between the axial support surface of the ejection element 4 and the bottom of the closing element 20. When the end of the stroke of insertion of the applicator 21 into the container 1 has substantially been reached, the user causes the internal thread 25 provided in the closing element 20 to cooperate with the external thread provided on the container neck 10 by relative rotation of these two elements about the longitudinal axis X over an angle of about 90°, thus transitioning the retaining device from the inoperative configuration to the operative configuration where the application assembly 2 is in the closed position on the container 1.

According to a particularly advantageous arrangement of the present invention, the container 1 is provided with a release device, separate from the retaining device, which is in the form of a rotatable ring 5 arranged near the neck 10 and rotatable about the longitudinal axis X between a rest position and a release position.

The angular displacement of this rotatable ring 5 between its rest position and its release position is limited by means of a system of rotational stops consisting of two radial projections 14 provided on the portion of the container arranged for receiving the ring 5, and designed to move within two internal guide tracks 54 provided in the ring 5, said ring 5 being urged towards its rest position under the effect of a biasing element. This biasing element is in the form of a rotating return spring 50 with one free end attached to the container 1 and the other free end attached to the ring 5.

As is particularly evident in FIG. 5, this rotatable ring 5 comprises an actuating element consisting of a radial projection 51 extending from the outer surface of the rotatable ring 5 and which a user can act upon to actuate the ring 5 between its rest position and its release position.

The rotatable ring 5 has also two grooved arcs 52 formed in the upper surface facing the application assembly 2 when the latter is in the closed position on the container 1. Each of these grooves has an end face 53 constituting a rotational drive element that cooperates with a respective front face 203 defined on two teeth 202 formed on a lower surface of the closing element 20 facing the ring 5.

When the ring 5 is actuated between the rest position and the release position, the cooperation of the end faces 53 of the grooves 52 and the front faces 203 of the teeth 202 rotates the application assembly 2 relative to the container 1 in the release direction of the retaining device 15 until it transitions to the inoperative configuration, which causes expansion of the resilient element 3 and ejection of the application assembly 2 relative to the container 1 towards its removal position.

As is particularly evident in FIG. 2*b*, when the application assembly 2 is in the closed position on the container 1, the retaining device being in the operative configuration and the ring 5 in the rest position, the teeth 202 of the application assembly 2 are received within the grooves 52 formed in the ring 5, the respective end faces 203 of said grooves 52 and front faces of said teeth 202 then facing one another.

Advantageously, the system for packaging and applying a product according to the invention may be provided with a sound-generating device for indicating that the retaining device has reached the operative configuration. In the embodiment illustrated in FIGS. 5, 5*a*, and 5*b*, this sound-generating device is in the form of a boss 54 provided on the bottom of at least one groove 52 of the rotatable ring 5, in the vicinity of its rotational driving end face 53, and intended to cooperate with a recess 204 formed in at least one tooth 202 of the closing element 20 in the vicinity of its front face 203. Thus, when the application assembly 2 is screwed onto the container 1, the teeth 202 of the closing element 20 enter and move within the grooves 52 of the rotatable ring 5, which is in the rest position, and when the application assembly 2 reaches the end of its travel as it is screwed onto the container 1, the recess 204 provided on at least one tooth 202 cooperates with the boss 54 provided on the bottom of at least one groove 52 in order to generate a noise or "click" indicating that the retaining device has reached the operative configuration where the application assembly 2 is in the closed position on the container 1.

In an alternative embodiment, not shown, the sound-generating device is in the form of a boss provided on the bottom of the internal thread 25 of the closing element 20 and adapted to cooperate with a notch provided in the external thread 15 of the container neck 10 in order to indicate that the retaining device has reached the operative configuration.

A sequence of inserting/removing the application assembly 2 relative to the container 1, making use of the release means 5, will now be described in relation to FIGS. 5 and 7*a* to 7*d*.

Figures 7A, 7B, 7C, 7D:
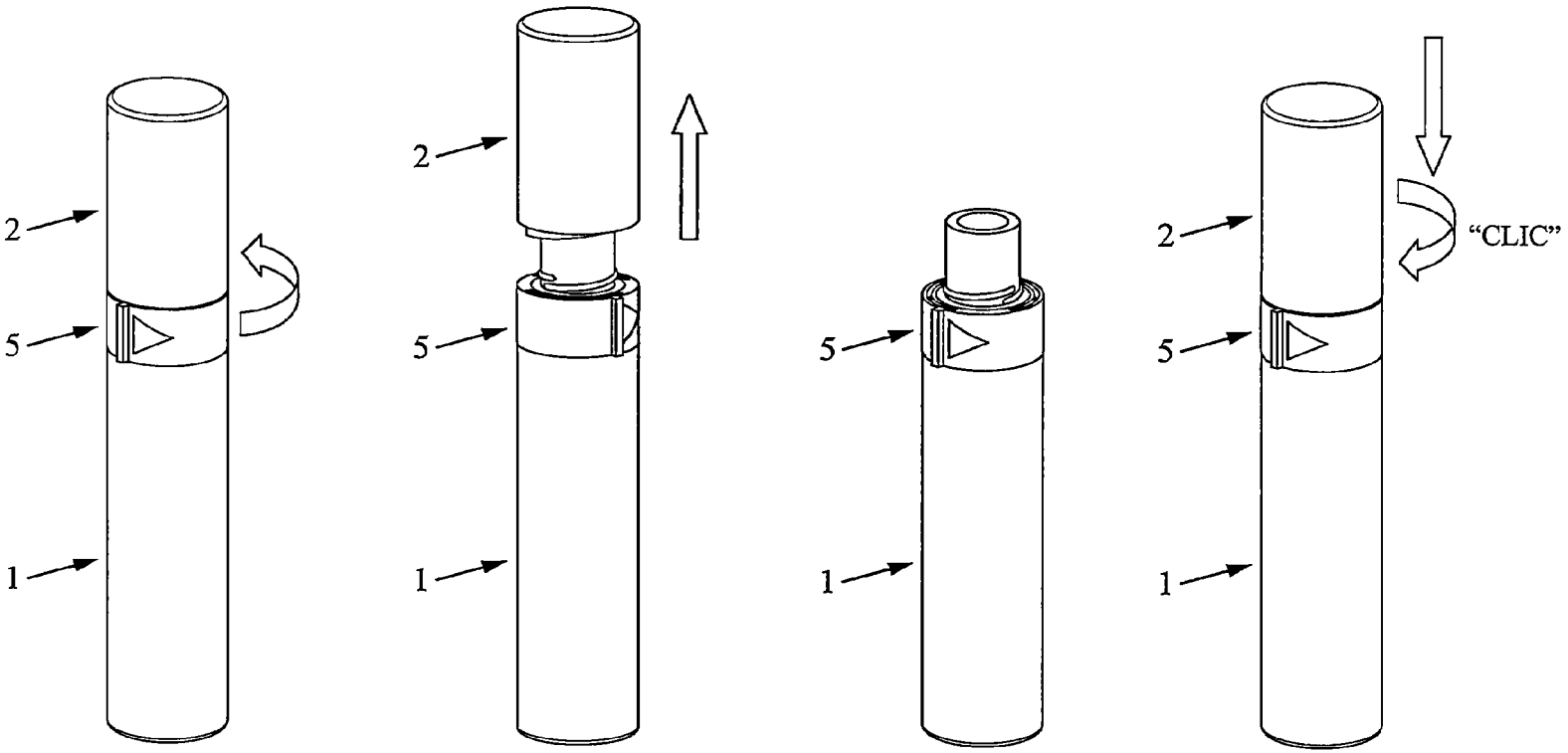
FIGS. 7*a* to 7*d* show a sequence of removing/inserting the application assembly relative to the container of a packaging and application system of the invention.

Starting from the situation illustrated in FIG. 7*a*, where the application unit 2 is in the closed position on the container 1, the retaining device 15, 25 is in the operative configuration, and the release device is in rest position 5, a user grasps the container 1, for example in the palm of her hand, and actuates the rotatable ring 5 between its rest position and its release position via the actuating projection 51, for example with her thumb. This involves rotating the ring 5 relative to the container 1 over a 90° angle about the longitudinal axis X.

During this rotation, the end faces 53 of the grooves 52 of the ring 5 cooperate with the front faces 203 of the teeth 202 of the application assembly 2, and cause said application assembly to rotate relative to the reservoir 2 until the internal thread 25 associated with the application assembly 2 disengages from the external thread 15 associated with the container 1.

The retaining device is then in the inoperative configuration, which causes expansion of the resilient element 3 and ejection of the application assembly 2 towards the outside of the container 1 as shown in FIG. 7*b*.

The user then grasps the application assembly 2 via its closing element 20, for example using her other hand, and removes it from the reservoir 1 to apply the product to a surface; in parallel, she releases the ring 5 which is then returned to its rest position by the spring 50, as shown in FIG. 7*c*.

To close the product packaging and application system according to the invention and return the application assembly 2 to the closed position on the reservoir, the user proceeds as described above and illustrated in FIG. 7*d*, with the teeth 202 of the application assembly 2 being received within the grooves 52 of the ring 5 when the application assembly 2 is in the closed position on the container 1.

The release device therefore constitutes an additional means for opening the packaging and application system. Indeed, opening this system, which corresponds to moving the application assembly between the closed position and the removal position, can be performed in two ways, namely by either holding the container 1 and acting directly on the application assembly 2 to move the retaining device to the inoperative configuration, or holding the container and actuating the release device 5 associated with the container 1, which moves the application assembly 2 until the retaining device is in the inoperative configuration. Such an arrangement improves the ergonomics of opening of the product packaging and application system, as the user is able to perform this operation of opening and removing the application assembly without having to act directly on said assembly or on an element associated with it.

Alternatively, the retaining device which holds the application assembly 2 on the container 1 may be in the form of a bayonet catch system. In the embodiment illustrated in FIG. 6, this bayonet catch system comprises four grooves 15' formed at the container neck 10' and designed to cooperate with four radial pins 25' provided on an insert 24' integral with the closing element 20 for the applicator 2. Each groove 15' has an axial portion 151' extending along the longitudinal direction X and a retaining portion 152' extending in the circumferential direction of the product packaging and application system. When the retaining device is in the operative configuration, the pins 25' are prevented from moving in the axial direction inside the retaining portions 152'. As shown in this FIG. 6, the retaining portions 152' provided at the container neck 10' extend over an arc of less than 90°, and more specifically of about 20°. Thus, the transition from the operative configuration to the inoperative configuration of the retaining device is achieved by rotation, in the release direction over a 20° angle about the longitudinal axis X, of the application assembly 2 relative to the container 1.

Furthermore, in the embodiment illustrated in FIG. 6, the rotatable ring 5' has four grooves 52' in which the end faces 53' are adapted to cooperate with the front faces 203' of four teeth 202' arranged on a bottom surface of the closing element 20', facing the ring 5', to force the application assembly 2' to rotate relative to the container 1 in the release direction, causing the retaining device to transition to the inoperative configuration.

Similarly to what was described in relation to the embodiment in FIG. 5, a recess may be provided on at least one tooth 202' in order to form, together with at least one boss arranged at the bottom of at least one groove 52', a sound-generating device for indicating that the retaining device has reached the operative configuration.

The sequence of opening and closing the product packaging and application system shown in FIG. 6 is similar to the sequence described above in relation to FIGS. 5 and 7*a*-7*d*, except that the transition of the retaining device from the operative configuration to the inoperative configuration is achieved by rotation of the application assembly 2 relative to the container 1 about the longitudinal axis X over a 20° angle, instead of a 90° angle. When a user holds the container 1, this transition of the retaining device to the inoperative configuration can be achieved either by acting directly on the application assembly 2 or on the ring 5' which is movably mounted to rotate on the container about the axis X over an an angular range of about 20° and which is provided for rotating the application assembly 2 relative to the container 1.

The invention claimed is:

1. A system for packaging and applying a product, comprising:

a container intended for containing said product and having a neck and a bottom, the neck extending along a longitudinal axis;

a product application assembly including a closing element adapted for closing the container, and a product applicator secured to said closing element and intended for insertion into said container in order to be loaded with the product to be applied;

a retaining device adapted for retaining said application assembly on said container, and mounted to be movable between an operative configuration in which the application assembly is retained on the container and an inoperative configuration in which the application assembly can be removed from the container;

an resilient element provided so as to adopt a stressed configuration when the retaining device is in the operative configuration, the transition to the inoperative configuration of the retaining device causing the expansion of said resilient element;

wherein the application assembly is movable along the longitudinal axis between a closed position in which the closing element seals the container, and a removal position where it is distanced from said container along the longitudinal axis, and wherein the resilient element in the stressed configuration biases the application assembly towards the removal position, the expansion of the resilient element resulting in movement of the application assembly along an axial ejection stroke relative to the container along the longitudinal axis;

characterized in that the system further comprises a release device, separate from the retaining device, arranged on the container so as to be movable between a rest position and a release position, the actuation thereof causing said retaining device to transition to the inoperative configuration.

2. The system for packaging and applying a product according to claim 1, wherein a biasing element is provided for returning the release device to its rest position.

3. The system for packaging and applying a product according to claim 1, wherein the release device comprises:

at least one actuating element which a user can act upon to actuate the release device, and at least one drive element for moving the application assembly relative to the container, adapted to transition the retaining device from its operative configuration to its inoperative configuration upon actuation of said release device.

4. The system for packaging and applying a product according to claim 3, wherein the transition of the retaining device from the operative configuration to the inoperative configuration is effected by rotation of the application assembly relative to the container about the longitudinal axis in a release direction, the at least one drive element provided on the release device being a drive element for rotating in the release direction.

5. The system for packaging and applying a product according to claim 3, wherein the release device is in the form of a rotatable ring arranged on the container in the vicinity of the neck, and having at least one groove formed in a surface facing the application assembly, the at least one rotational drive element being formed by a front end of said groove adapted to cooperate with a front face of at least one tooth formed in a surface of the application assembly facing said ring, said at least one tooth being received within said at least one groove when the application assembly is in the closed position.

6. The system for packaging and applying a product according to claim 5, wherein the at least one actuating element is in the form of a radial rib protruding from the outer surface of the rotatable ring.

7. The system for packaging and applying a product according to claim 1, wherein the retaining device is in the form of an external thread provided on the neck of the container and adapted to engage with an internal thread provided in the closing element of the application assembly.

8. The system for packaging and applying a product according to claim 7, wherein the external thread provided on the neck and the internal thread provided in the closing element are adapted for transitioning from the operative configuration to the inoperative configuration by a relative rotation in the release direction about the longitudinal axis over an angle of less than 360°, preferably less than 180°, and even more preferably about 90°.

9. The system for packaging and applying a product according to claim 1, wherein the retaining device is in the form of a bayonet catch system comprising at least one groove provided on the container neck and adapted to engage with at least one pin provided in the closing element of the application assembly, said groove having an axial portion and a retaining portion extending in the circumferential direction of the product packaging and application system over an arc of less than 90°, and preferably about 20°.

10. The system for packaging and applying a product according to claim 1, further comprising a sound-generating device adapted for indicating that the retaining device has reached the end of its travel when it transitions from the inoperative to the operative configuration.

11. The system for packaging and applying a product according to claim 1, further comprising an ejection element movably arranged inside the closing element of the application assembly and having a face adapted for bearing axially on the container, as well as an axial stop for cooperating with an axial stop provided in the closing element in order to limit the movement of said ejection element within said closing element, the resilient element being arranged between said ejection element and said closing element, and the ejection stroke of said application assembly relative to said container corresponding to at least the axial distance between said stops when the retaining device is in the operative configuration.

12. The system for packaging and applying a product according to claim 1, wherein the applicator comprises a shaft extending along the longitudinal axis from the bottom of the closing element and equipped at a free end with an applicator head to be loaded with product to be applied, and wherein the container is provided with a wringing element adapted for wringing said applicator head.

13. The use of a system for packaging and applying a product according to claim 1, in order to apply a cosmetic product to a surface.

* * * * *